US005280759A

United States Patent [19]

Scholl

[11] Patent Number: 5,280,759

[45] Date of Patent: Jan. 25, 1994

[54] AUTOMATIC SEWING DEVICE

[75] Inventor: Hans Scholl, Oerlinghausen-Lipperreihe, Fed. Rep. of Germany

[73] Assignee: Durkopp Adler Aktiengesellschaft, Fed. Rep. of Germany

[21] Appl. No.: 751,172

[22] Filed: Aug. 28, 1991

[30] Foreign Application Priority Data

Sep. 21, 1990 [DE] Fed. Rep. of Germany ..... 4029891

[51] Int. Cl.[5] ..... D05B 21/00

[52] U.S. Cl. ..... 112/121.12; 112/121.15; 112/DIG. 2

[58] Field of Search ..... 112/121.12, 121.15, 112/104, 113, 102, 103, 121.11, DIG. 2

[56] References Cited

U.S. PATENT DOCUMENTS

| | | | |
|---|---|---|---|
| 4,312,283 | 1/1982 | Fischer | 112/121.12 |
| 4,498,404 | 2/1985 | Sadeh | 112/121.12 |
| 4,541,348 | 9/1985 | Fischer | 112/121.12 |
| 4,905,618 | 3/1990 | Scholl | 112/121.12 |
| 5,014,633 | 5/1991 | Murata et al. | 112/121.12 |

FOREIGN PATENT DOCUMENTS

| | | |
|---|---|---|
| 3134028 | 2/1985 | Fed. Rep. of Germany . |
| 3216528 | 11/1986 | Fed. Rep. of Germany . |
| 240589 | 8/1989 | Fed. Rep. of Germany . |

*Primary Examiner*—Peter Nerbun

*Attorney, Agent, or Firm*—Laff, Whitesel, Conte & Saret

[57] ABSTRACT

An automatic sewing device for the sewing of workpieces of different size, such as collars, cuffs or the like, the workpieces having a seam section extending in a straight line where they differ in size, has a workpiece holding plate to press the workpiece on a bearing plate and to displace it on the bearing plate. The workpiece holding plate has two seam forming sections of maximum possible size and is made in one piece. Further devices are provided for shifting the workpiece holding plate after a 1st seam contour section has been sewn to move said workpiece holding plate with respect to said 1st seam contour section to a position of the workpiece holding plate where a second seam forming section corresponds to a second seam contour section.

13 Claims, 6 Drawing Sheets 2
6
10
3
7
8
9
x
III
III
44
43
44
48
42
39
46
11
5
73
45
46
35
33'
34
26
13
26
14
15
30
24
22
16'
21
1

38
2
6
y
3
42
43
12
7
8
4
48
39'
9
39
46
45
(37)
35
36
26
5
11
25
32'
13
33'
28
29'
15
24
15
14
30'
1
22

AUTOMATIC SEWING DEVICE

FIELD OF THE INVENTION

The invention relates to an automatic sewing device for the sewing of workpieces of different size, such as collars, cuffs or the like, the workpieces having a seam section extending in a straight line where they differ in size, comprising a sewing machine with stitch forming instruments, a workpiece holder for workpieces of different size, a bearing plate for the workpieces and the workpiece holder, and devices for controlled shifting of the workpiece holder relative to the stitch forming instruments, the workpiece holder having a workpiece holding plate with seam forming sections adapted to the seam contour to be sewn.

BACKGROUND OF THE INVENTION

An automatic sewing device is known from DE 32 16 528 C2, in which, prior to the actual sewing process, a workpiece holder is adjusted in size to match a workpiece to be sewn, for instance a collar or a cuff. For the purpose of automatically balancing the adjustment of size and the seam contour, the adjustment of size is detected as a measuring length and passed on to a control unit of the automatic sewing device. It is of disadvantage that an adjustment of size of the workpiece holder to match the size of each workpiece to be sewn in necessary prior to the sewing process. The workpiece holder adjustable in size has a complicated structure. The workpiece holder itself is huge and requires a correspondingly dimensioned sewing panel.

An apparatus is known from DE 89 06 434 U1 to be used in an automatic sewing device for automatically balancing the adjustment of size for collar sewing. In this case the size of a collar is detected by opto-electronic sensors, after the collar has first been put against a reference stop. Corresponding to the collar size detected, a workpiece holder consisting substantially of a stationary half-plate and of a second half-plate displaceable in longitudinal direction of the collar is automatically adjusted. This is comparatively expensive, too.

An automatic sewing device is known from DE 31 34 028 C2 to have a feeder with a workpiece holder. After a first seam contour section has been sewn, the workpiece holder is shifted on the workpiece; then a second seam contour section is sewn. The reason why the workpiece holder is shifted with the workpiece resides in that a seam contour is to be produced, of which the dimensions exceed the size of the sewing field available, i.e. the size of the area run over by the workpiece holder.

SUMMARY OF THE INVENTION

It is an object of the invention to embody an automatic sewing device of the generic kind ensuring automatic adjustment of the workpiece holder to the workpiece and automatic adjustment of the sequence of operations of the sewing machine for the production of a desired seam contour.

In accordance with the invention this object is attained in an automatic sewing device of the generic kind in that the workpiece holding plate is structured to press the workpiece on the bearing plate and to displace the workpiece on the bearing plate, in that the workpiece holding plate has two seam forming sections of maximum possible size and is made in one piece, and in that devices are provided for shifting the workpiece holder after a 1st seam contour section has been sewn to move to a position of the workpiece holding plate, in which position a 2nd seam forming section corresponds to a 2nd seam contour section. The workpiece holding plate of the workpiece holder is made in one piece or integrally, i.e. there are no mechanical adjustments of the workpiece holding plate to adapt to different sizes of a collar, a cuff or the like. The workpiece holding plate is structured such that it ensures sewing of the greatest possible workpiece, in particular collars or cuffs. The adjustment to different sizes of workpieces is realized by shifting the workpiece holder, whenever about the middle of the seam to be produced has been reached—in particular in the case of mirror symmetrical workpieces.

The development according to which the seam forming sections each have 1st sections of arbitrary shape and straight-lined 2nd sections facing each other and extending in parallel to each other, ensures particularly simple shifting of the workpiece holder parallel to itself, in which case the seam contour sections may be in parallel alignment or in parallel displacement one relative to the other. A particularly space-saving embodiment of the workpiece plate is achieved by the measures according to which two recesses displaced one within the other are formed in the workpiece holding plate as seam forming sections of maximum possible size and have each a 1st section and a 2nd section, while the development according to which the 2nd sections are connected with each other by a connecting recess, ensures that the needle can remain in its position stitched into the workpiece when the workpiece holder is shifted, whereby the workpiece is fixed and a thread cutting process is avoided.

In a further embodiment according to which the 2nd sections join at each of their ends, the needle can in any case remain stitched in during shifting. In this case it is of advantage that the workpiece holder is stable in structure and can be manufactured at favorable costs. In this embodiment the seam contour sections may also correspond to a contour of the workpiece plate, i.e. corresponding recesses need not necessarily be contained in the workpiece plate. However, it is of course of advantage when the 1st and 2nd sections are formed as recesses in the holding plate.

The further development according to which the holding plate can be lifted off the bearing plate in parallel to itself and perpendicularly to the latter, ensures that upon shifting of the workpiece holder the workpiece plate is displaced parallel to itself, i.e. there are no displacements of the workpiece on the bearing plate. To this effect a drive is provided on the workpiece holder to lift the holding plate off the bearing plate.

When the needle cannot remain in its stitched-in position while the workpiece holder is shifted, it is of advantage if a retaining device for the workpiece is provided in the bearing plate adjacent to the stitch forming instruments, and in particular if a suction device is provided adjacent to the stitch forming instruments.

In particular, the invention permits a further development and automation of the process by means of the automatic sewing device being provided with a size measuring device for the workpiece and by the control unit being formed so as to trigger the retaining device.

Further advantages, features and details of the invention will become apparent from the ensuing description of preferred embodiments taken in conjunction with the drawing.

DESCRIPTION OF THE PREFERRED EMBODIMENTS

Figure 1:
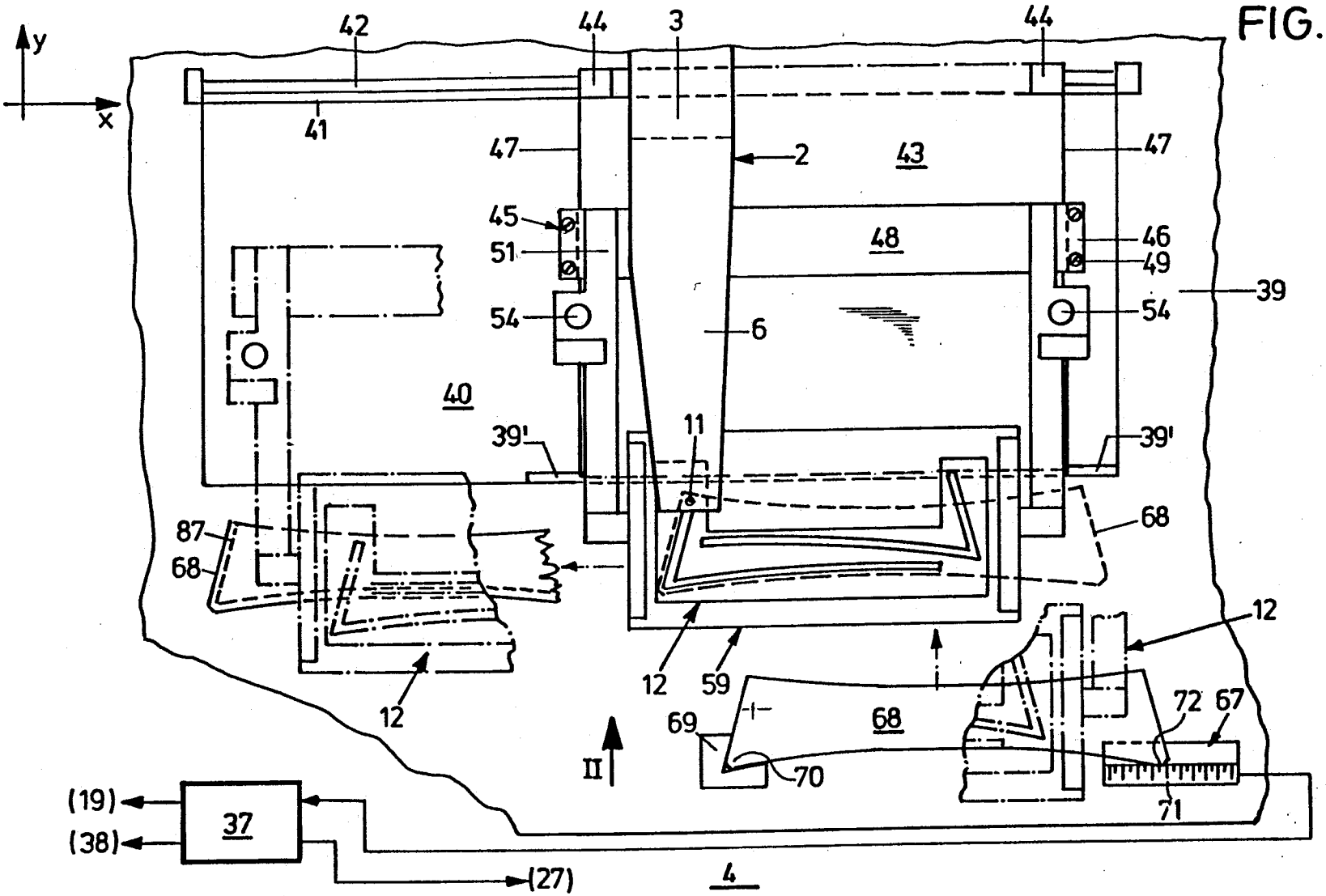
FIG. 1 is a plan view of an automatic sewing device in an illustration partially broken open.
Figure 2:
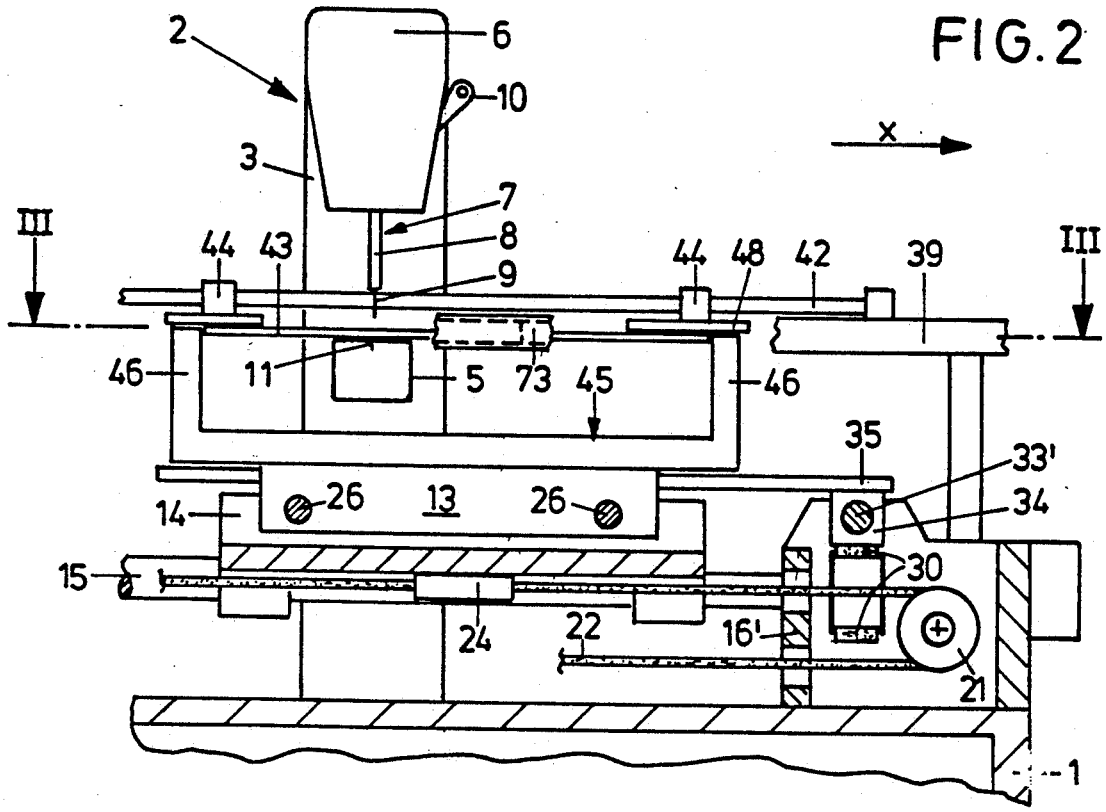
FIG. 2 is a front view of an automatic sewing device according to arrow II in FIG. 1 in an illustration partially broken open.
Figure 4:
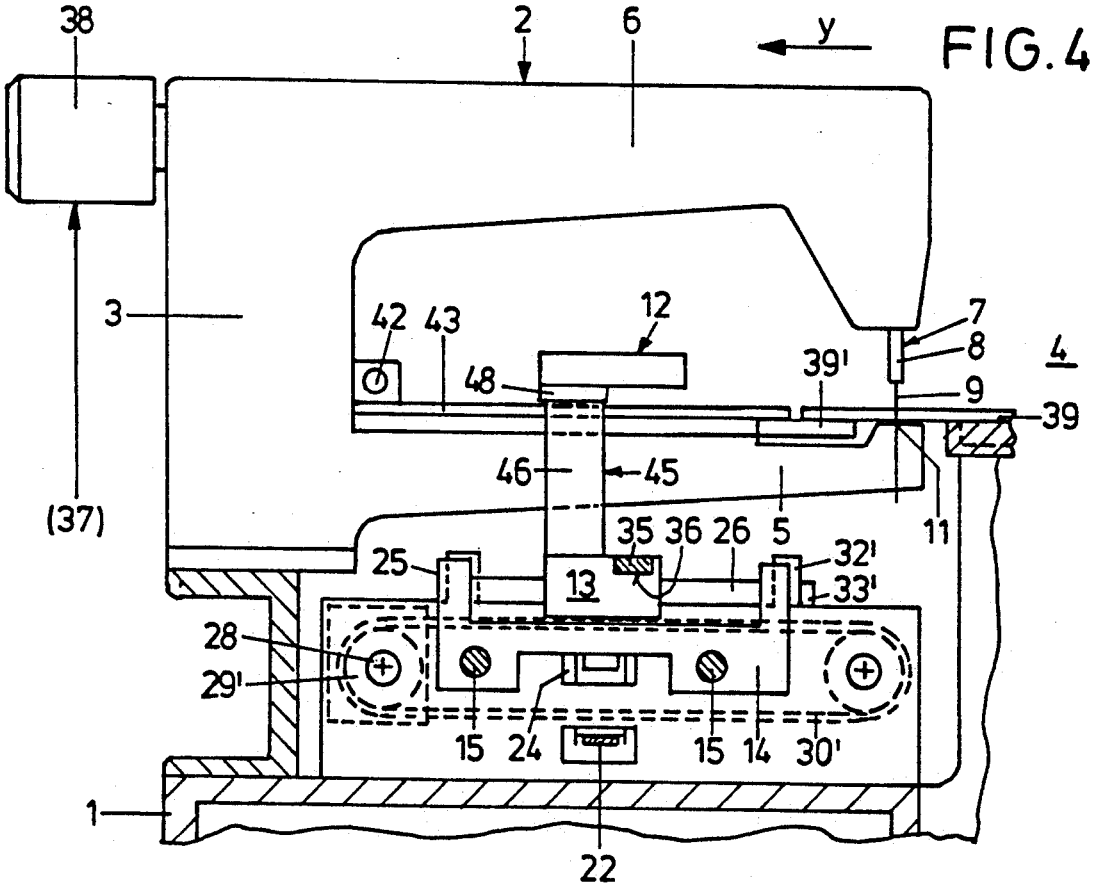
FIG. 4 is a vertical cross-section through the automatic sewing device according to section line IV—IV in FIG. 3.

The automatic sewing device shown in FIGS. 1 to 4 has a stand 1, in the central section of which a sewing machine 2 is arranged, of which the standard 3 is secured to the stand 1. The sewing machine 2 further has a base plate 5 horizontally projecting from the vertically-arranged standard 3 towards the operator's side 4 and an upper arm 6 projecting from the upper end of the standard 3 in parallel to the base plate 5 equally towards the operator's side 4. Stitch forming instruments 7 are provided in the proximity of the free ends of the base plate 5 and the arm 6, of which instruments only a needle bar 8 to be driven up and down with a needle 9 and a thread feeder 10 are roughly outlined on the arm 6, while only a stitch hole 11 is outlined on the base plate 5.

Figure 3:
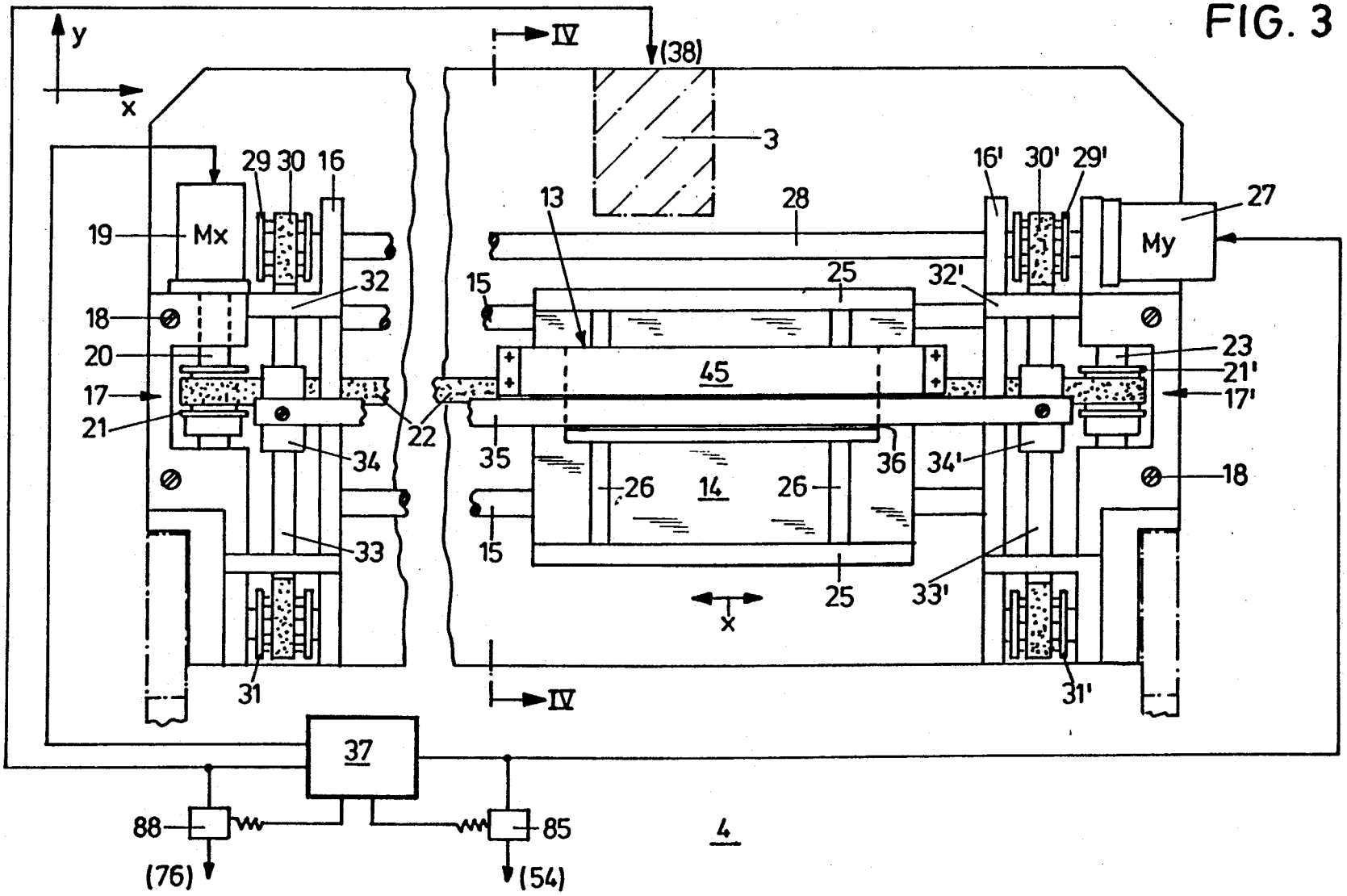
FIG. 3 is a horizontal section through the automatic sewing device according to section line III—III in FIG. 2.

A workpiece holder 12, which will still be described in detail below, is provided between the base plate 5 and the arm 6 in the proximity of the stitch forming instruments 7. This workpiece holder 12 is displaceable in two coordinate directions, namely in y-direction corresponding approximately to the main direction of the sewing machine 2, and in x-direction extending perpendicularly to the latter, as seen in FIGS. 1 and 3. To this effect the workpiece holder 12 is arranged on an x-y-carriage system. This carriage system has a y-carriage 13, which directly carries the workpiece holder 12 and which is supported and guided on an x-carriage 14 and is displaceable relative to the latter in y-direction. The x-carriage 14 is in turn displaceable in x-direction relative to the stand 1. Consequently, the y-carriage 13 together with the workpiece holder 12 are displaceable in x- and y-direction relative to the stand 1, the x-y-plane extending substantially horizontally.

The x-carriage 14 is displaceably arranged on two guide rods 15, which are stationarily mounted to the stand 1 and which extend parallel to each other. The guide rods 13 are received with each of their ends in bearing webs 16, 16' of bearing blocks 17, 17' mounted to lateral sections of the stand 1 by means of screws 18. A drive motor 19 for the x-carriage 14 is mounted to one bearing block 17—associated with the left part of the stand 1 in FIG. 3. This motor 19 drives a timing belt pulley 21 via a shaft 20 supported in the bearing block 17. The timing belt pulley 21 in turn drives an endless timing belt 22 guided over a timing belt pulley 21'. This timing belt pulley 21' is rotatably supported via an axis 23 in the bearing block 17' of the stand 1. The upper strand of this timing belt 22 is secured to the lower surface of the x-carriage 14 by means of fastening means 24, so that the x-carriage 14 is displaced on the guide rods 15 in x-direction when correspondingly driven by the drive motor 19.

The x-carriage 14 is provided with side walls 25, which extend in x-direction and carry guide rods 26 extending in y-direction, on which rods 26 the y-carriage 13 is supported to be displaceable in y-direction.

The drive of the y-carriage 13 is accomplished by a drive motor 27. The drive motor 27 is mounted to the bearing block 17' and directly drives a shaft 28 supported in the two bearing blocks 17, 17'. The shaft 28 extends in x-direction. In both bearing blocks 17, 17' timing belt pulleys 29, 29' are fixedly mounted to the shaft 28 and each drive an endless timing belt 30 and 30', respectively. Each of the timing belts 30, 30' is guided via timing belt pulleys 31, 31' also supported in the bearing block 17 and 17', respectively. In parallel with and above the timing belts 30, 30' guide rods 33, 33' are mounted in webs 32, 32' of each bearing block 17, 17'. To each of the guide rods 33, 33' there is mounted a slide bearing 34 and 34', respectively, displaceable in y-direction. The two slide bearings 34, 34' arranged oppositely to one another are connected by a guide bar 35 extending in x-direction. Each end of the guide bar 35 is screwed to the corresponding slide bearing 34 or 34', respectively. The guide bar 35 engages a guide groove 36, which is located in the upper surface of the y-carriage 13 and which is matched to the outer circumference of the guide bar 35. The guide groove 36 and the guide bar 35 have no clearance in y-direction. Due to the drive of the guide bar 35 in y-direction, i.e. transversally with respect to its longitudinal direction, by means of the timing belts 30, 30' engaging the two ends of the guide bar 35 via the slide bearings 34, 34' a canting-free drive of the y-carriage 13 in y-direction is achieved. Movements of the y-carriage 13 together with the x-carriage 14 in x-direction are possible without problems since the guide bar 35 absolutely extends in parallel with the guide rods 15, while a correct drive and a correct guidance in y-direction is achieved due to the fact that the guide rods 33, 33' absolutely extend in parallel with the guide rods 26.

The drive motors 19 and 27 may be stepping motors or d.c. motors with position feedback, which produce a very precise program-controlled drive of the x-carriage 14, the y-carriage 13 and thus of the workpiece holder 12 in x-y-direction. A freely programmable control unit 37, via which also a drive motor 38 for the sewing machine can be triggered, is provided for the program control of the drive motors 19, 27.

A bearing plate 39 is arranged on the stand 1 in a horizontal plane between the stitch hole 11 in the base plate 5 and the needle bar 8 and has a large rectangular recess 40 releasing the path of displacement of the y-carriage 13. A guide rod 42, on which a supporting plate 43 is slidably guided by means of slide bearings 44, is arranged on the bearing plate at the longitudinal edge 41 of the recess 40 located at the standard 3. On its side facing the operator's side 4 the supporting plate 43 bears on a supporting strip 39' according to FIG. 4. This is a component part of the bearing plate 39. The guide rod 42 extends in parallel to the guide rods 15, so that the support plate 43 is displaceable in x-direction on the guide rod 42. The top side of the support plate 43 is in alignment with the top side of the bearing plate 39. It completely fills the recess 40 in y-direction.

Figure 6:
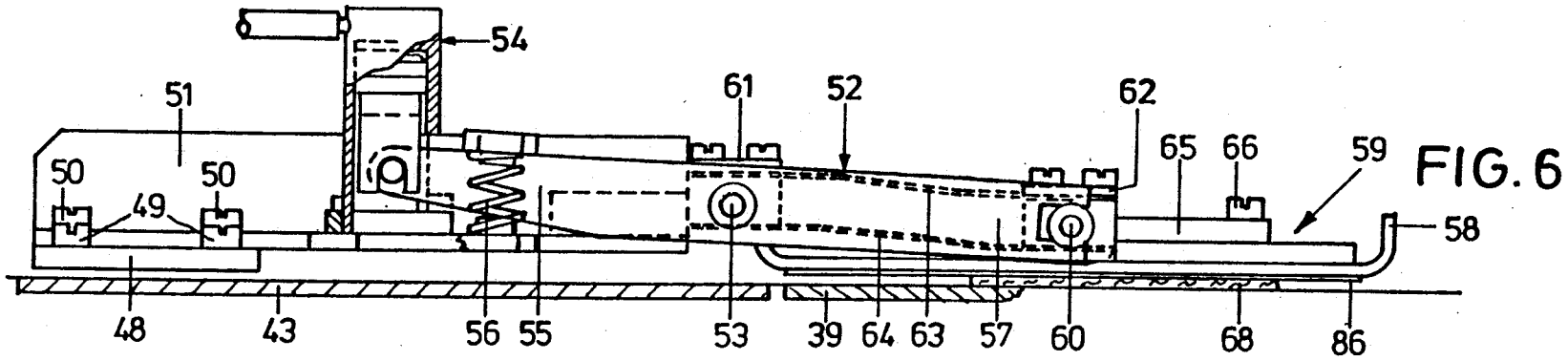
FIG. 6 is a partial section through the workpiece holder according to section line VI—VI in FIG. 5.
Figure 7:
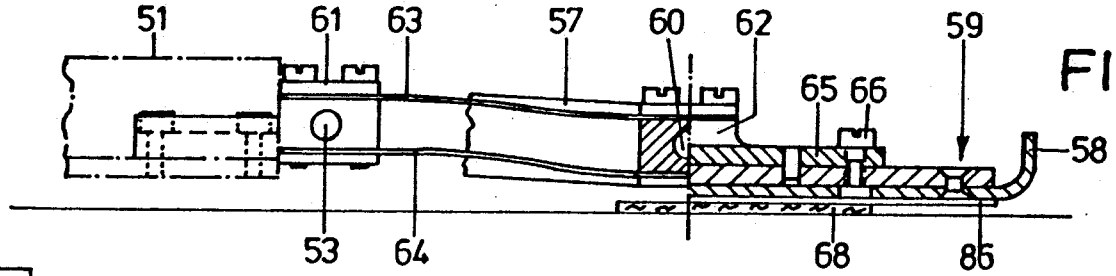
FIG. 7 is a sectional view of the workpiece holder according to section line VII—VII in FIG. 5.
Figure 8:
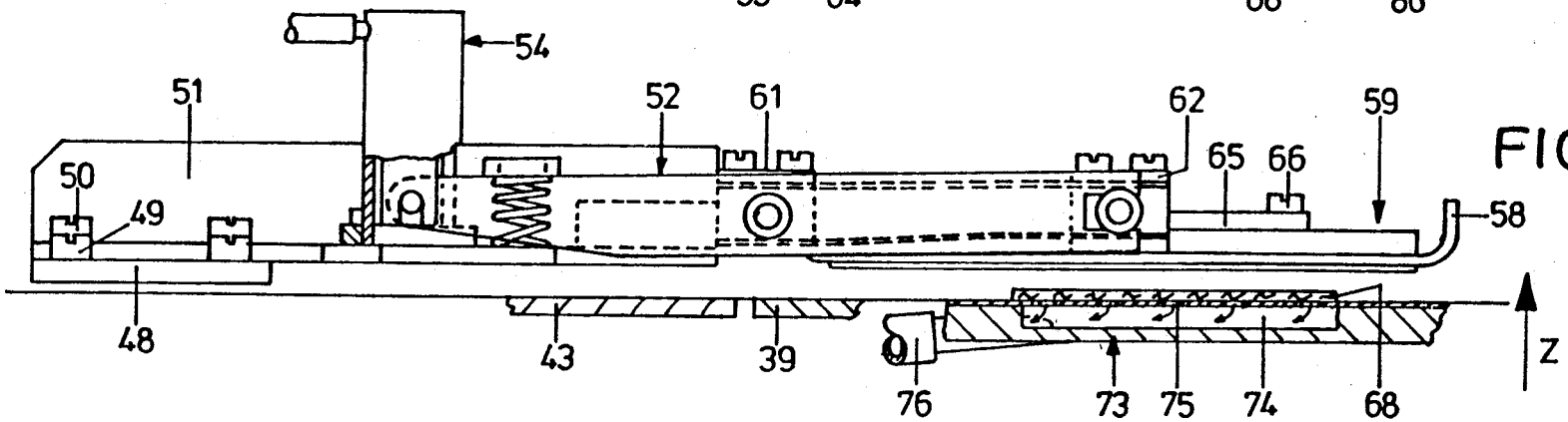
FIG. 8 is a lateral view of the workpiece holder according to arrow VIII in FIG. 5 in an illustration partially broken open.

A U-shaped support 45 is disposed on the y-carriage 13, the vertical legs 46 of which support 45 overlapping the edges 47 extending in y-direction of the supporting plate 43, so that these legs 46 take along the supporting plate 43 upon displacement movements of the y-carriage 13 in x-direction, whereas the two legs 46 freely run along the edges 47 upon displacement movements of the y-carriage 13 in y-direction. Above the supporting plate a carrier 48 of the workpiece holder 12 is secured to the free ends of the legs 46 by means of screws 49. Two arms 51 parallel to each other and extending in y-direction are in turn mounted to the carrier 48 by means of screws 50. A two-armed lever 52 is articulated on each of the free ends of the arms 51 facing the operator's side 4 to pivot about a pivot axis 53 extending in x-direction. A pneumatically actuatable piston cylinder drive 54 is arranged on each arm 51, it engages with the associated partial lever 55 of the lever 52 and can pivot the latter downwards towards the supporting plate 43 in a direction opposite the z-direction. Upon relief of the drive 54 the lever 52 is again pivoted into its position shown in FIGS. 6 and 7 by means of one or several pretensioned helical compression springs 56 engaging between it and the lever 52. Due to the described pivoting operations the partial levers 57 are pivoted in opposite direction. A U-shaped supporting frame 58 of a work-piece holding plate 59 is articulated on their free ends facing the operator's side 4 in each case by means of a swivel hinge 60. Clamping means 61, 62 are rigidly mounted to each the front end facing the operator's side 4 of each arm 51 and the supporting frame 58, into each of which clamping means 61, 62 a pair of leaf springs 63, 64 extending in parallel to one another in y-direction and arranged one above the other in z-direction are clamped with their ends. Together with the two clamping means 61, 62 they form a parallel guidance, so that, when the levers 52 are pivoted as described by corresponding pneumatic actuation of the drives 54 or by their pneumatic relief the supporting frame is pivoted parallel to itself in z-direction. The displacements in y-direction occurring due to the pivoting are negligible.

The supporting frame 58 is secured to carrying strips 65 connected with the clamping device 62 by means of screws 66 so that it is replaceable.

In the field of the operator's side 4 a size measuring device 67 is arranged on the bearing plate to detect the size of a workpiece to be sewn, in the present case a collar 68. This size measuring device 67 has a reference stop 69, to which is put a reference point 70, i.e. a collar tip, or a reference edge. The size measuring device 67 further has a sensor 71 detecting the position of a further reference stop 72, for instance the other collar tip, of the workpiece to be sewn. The size of the workpiece, for instance of the collar 68, measured by the size measuring device 67 is transmitted to the control unit 37 as a corresponding signal.

On both sides of the stitch forming instruments 7 a suction device 73 is provided in the bearing plate 39 and comprises a suction chamber 74 secured to the bottom side of the bearing plate 39 and suction openings 75 provided in the bearing plate 39 and associated with the suction chamber 74. The suction chamber 74 is connected to a vacuum source by means of a suction connection 76.

Figure 5:
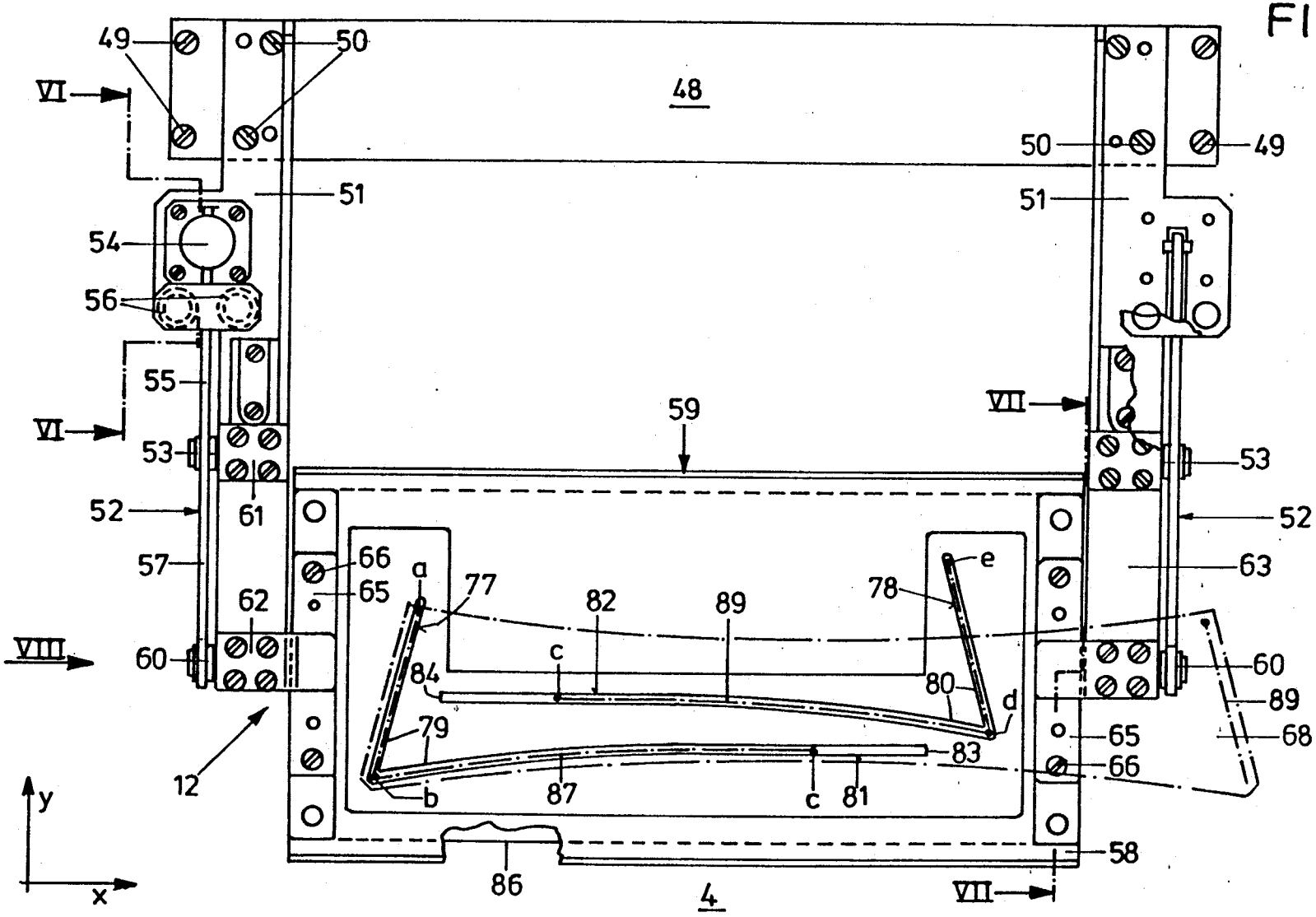
FIG. 5 is a plan view of a workpiece holder in an illustration partially broken open.

The workpiece holding plate 59 provided in the embodiment according to FIGS. 1 to 8 has two slot-like recesses 77, 78, of which the recess 77 shown on the bottom left in FIGS. 1 and 5 corresponds to a 1st seam contour section, while the other recess 78 illustrated on the right slightly above the latter corresponds to a 2nd seam contour section. Each recess has a 1st section 79 or 80 to be sewn with each workpiece, for instance with each collar 68. Further, each recess 77 or 78, respectively, has a 2nd section 81 or 82 extending in a straight line, and these two 2nd recesses 81, 82 overlap the area of minimum and maximum size of the workpiece, for instance of the collar 68. When the two recesses 77, 78 are put together at the ends 83, 84 of the 2nd sections 81, 82, then they overlap an area of maximum size of a collar 68.

The sewing of a collar 68 with this device is made as described in the following:

A collar 68 to be sewn is placed into the size measuring device 67 as described above, whereby the measured size of the collar 68 is transmitted to the control unit 37 by the sensor 71 which may for instance be opto-electronic. Then the control unit 37 triggers the drive motors 19 and 27 and a solenoid valve 85 for actuation of the drives 54, so that the workpiece holder 12 is driven over the collar 68 with the holding plate 59 lifted off the bearing plate 39 in z-direction. When the workpiece holder 12 is in its correct position over the collar 68, the drive motors 19, 27 are stopped and the drives 54 are pneumatically relieved via the solenoid valve 85, so that the holding plate 59 is lowered onto the collar 68, whereupon the recess 77 takes its correct bearing position on the collar 68. Then the drive motors 19, 27 are again triggered by the control unit 37, so that the collar 68 is conveyed into the vicinity of the stitch forming instruments 7. To this effect the bearing plate 39 is extra-ordinarily smooth on the one hand and, on the other hand, the bottom of the holding plate 59 is provided with an adhesive surface 86. Then the 1st seam contour section 87 is sewn. For this purpose sewing takes place starting from a point a via a point b at the tip of the collar 68 to a point c in the 2nd section 81 of the recess 77. To this effect the drive motors 19 and 27, on the one hand, and the drive motor 38 of the sewing machine 2, on the other hand, are correspondingly triggered by the control unit 37. At the point c corresponding to the center of the mirror symmetrical collar 68 the sewing operation is stopped, i.e. the drive motors 19 and 27 are stopped and the thread is cut in usual manner while the needle 9 is in its position drawn out of the collar 68. Simultaneously the suction chamber 74 is acted upon by vacuum by way of a solenoid valve 88 being triggered, so that the collar 68 is held tight on the bearing plate 39 in its position. Then the piston cylinder drives 54 are acted upon by pressurized air by way of the solenoid valve 85 being correspondingly triggered, so that the holding plate 59 is lifted off the collar 68. Subsequently the drive motors 19, 27 are triggered in such a way that the recess 78 is placed with its 2nd section 82 at least partially over the first seam contour section 87. Thus, the recess 78 of the workpiece holder plate 59 moves with respect to the first seam contour section 87. Then the holding plate 59 is lowered onto the collar 68 in described manner, the vacuum in the suction chamber 74 is switched off and the drive motors 19, 27, 38 are again put into service, so that the 2nd seam contour section 89 is sewn, which is precisely mirror symmetrical to the 1st seam contour section 87. The sewing operation thus continues from the point c via a point d located in the other tip of the collar 68 and from there to the end point e of the seam. At the end of the sewing operation the workpiece holder 12 and the collar 68 are in the position outlined on the left in FIG. 1. Then all drive motors 19, 27, 38 are stopped, the thread is cut off and the holding plate 59 is lifted. Now the finished collar 68 can be taken out, while the workpiece holder 12 is simultaneously moved again to the size measuring device 67 into the starting position, where the next collar 68 lies ready to be sewn.

Figure 9:
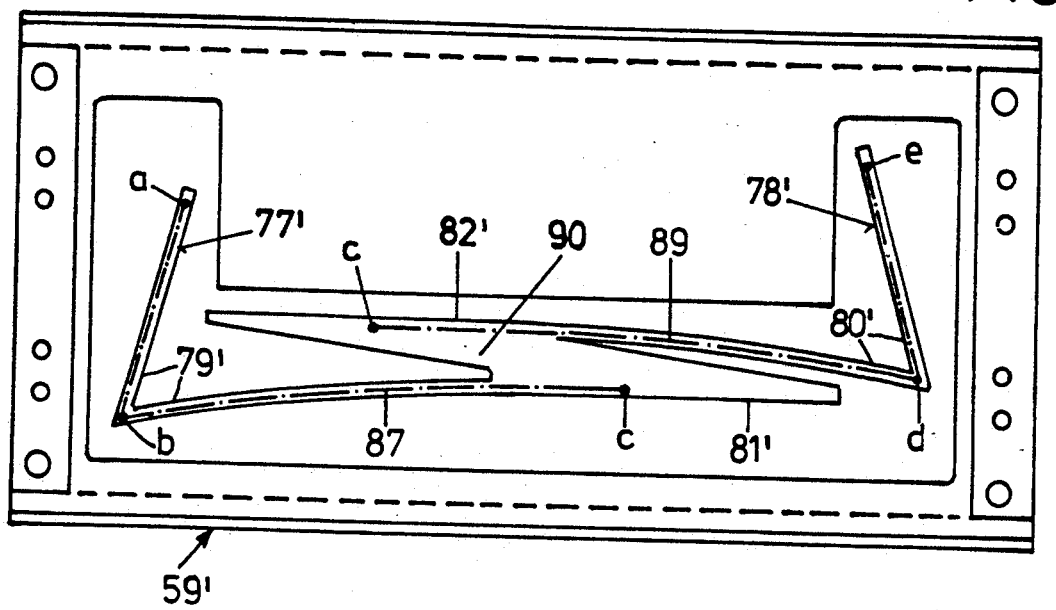
FIG. 9 is a modified embodiment of a workpiece holding plate for a workpiece holder.

FIG. 9 shows a modified workpiece holding plate 59' corresponding in principle to the holding plate 59 with the recesses 77, 78. For this reason corresponding parts have an identical reference numeral with a prime, so that a renewed basic description can be refrained from. The difference from the holding plate 59 resides in that the 2nd sections 81', 82' of the two recesses 77', 78' are connected with each other by a connecting recess 90, so that after sewing of the 1st seam contour section 87 the needle 9 can remained stitched in at point c. Then the workpiece holder 12 is shifted in described manner by displacement in relation to the needle 9 such that the latter is piloted through the connecting recess 90. Subsequently sewing of the 2nd seam contour section 89 takes place in the 2nd section 82' and in the 1st section 80'.

Figure 10:
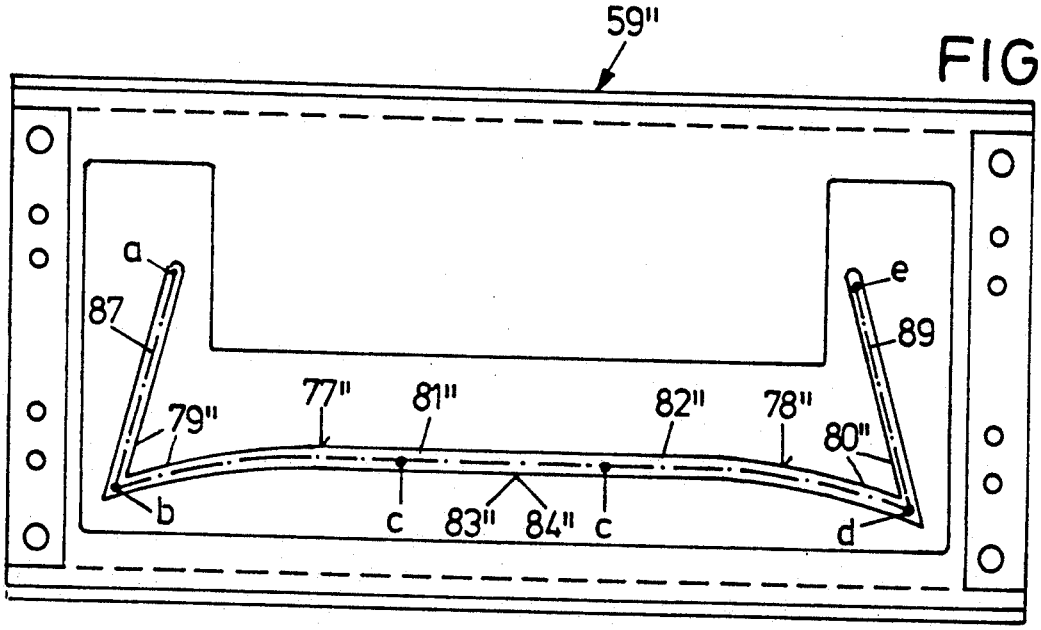
FIG. 10 is a further embodiment of a workpiece holding plate for a workpiece holder.

Finally, a holding plate 59" is illustrated in FIG. 10, of which the recesses 77" and 78" are joined together such that the sum of the 2nd sections 81" and 82" is in the dimension of a maximum size of a collar 68 in the central area. If collars 68 are to be sewn that are smaller in size than the maximum possible size, then the 1st seam contour section 87 is sewn to the point c ahead of the end 83" of the 2nd section 81", which coincides with the end 84" of the 2nd section 82". Subsequently the workpiece holder 12 in shifted in described manner while the needle 9 is stitched in and then sewing is continued from point c onwards. Each shifting takes place in mirror symmetry to the ends 83", 84".

Figure 11:
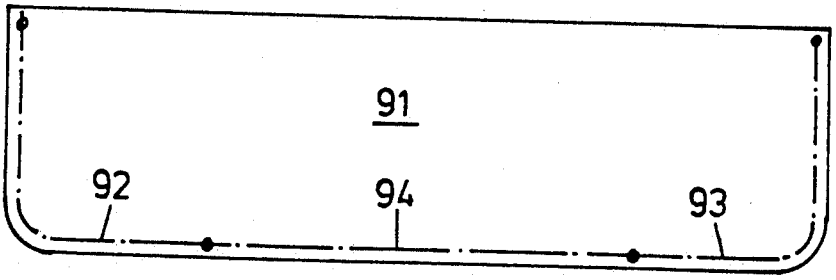
FIG. 11 is a plan view of a cuff.

A cuff 91 is illustrated in FIG. 11 having 1st and 2nd seam contour sections 92, 93 in like manner, the straight middle section 94 being structured in described manner to have different lengths, i.e. cuffs of different sizes can be sewn.

What is claimed is:

1. An automatic sewing device for the sewing of workpieces of different size, such as collars, cuffs or the like, having a seam section extending in a straight line where said workpieces differ in size, comprising:

a sewing machine (2) with stitch forming instruments (7);

a workpiece holder (12) for workpieces of different size, the workpiece holder (12) having a workpiece holding plate (59, 59', 59") with seam forming sections adapted to the seam contour to be sewn;

a bearing plate (39) for the workpieces and the workpiece holder (12), and devices for the controlled shifting of the workpiece holder (12) relative to the stitch forming instruments (7);

said workpiece holding plate (59, 59', 59") having means to press a workpiece on said bearing plate (39) and said workpiece holding plate (59, 59', 59") consisting of one piece and having first and second seam forming sections of substantially maximum possible size; and means for shifting said workpiece holder (12) after a first seam contour section (87) has been sewn to move said workpiece holder with respect to said first seam contour section to a position of the workpiece holding plate (59, 59', 59"), in which said second seam forming section corresponds to a second seam contour section (89).

2. An automatic sewing device according to claim 1, wherein the seam forming sections each have first sections (79, 80; 79', 80'; 79", 80") of arbitrary shape and straight-lined second sections (81, 82; 81', 82'; 81", 82") facing each other and extending approximately in parallel to each other.

3. An automatic sewing device according to claim 2, wherein two recesses (77, 78; 77', 78') displaced one within the other are formed in the workpiece holding plate (59, 59') as seam sections of substantially maximum possible size and have each a first section (79, 80; 79',80') and a second section (81, 82; 81', 82').

4. An automatic sewing device according to claim 3, wherein the second sections (81', 82') are connected with each other by a connecting recess (90).

5. An automatic sewing device according to claim 2, wherein the second sections (81", 82") join at each of their ends (83", 84").

6. An automatic sewing device according to claim 5, wherein the first and second sections (79", 80"; 81", 82") are formed as recesses (77", 78") in the holding plate (59").

7. An automatic sewing device according to claim 1, wherein the holding plate (59, 59', 59") can be lifted off the bearing plate (39) in parallel to said holding plate (59, 59', 59") and perpendicular to said bearing plate (39).

8. An automatic sewing device according to claim 7, wherein the workpiece holder (12) is provided with a drive (54) for lifting the holding plate (59, 59', 59") off the bearing plate (39).

9. An automatic sewing device according to claim 1, wherein a retaining devide (73) for the workpiece (68, 91) is provided in the bearing plate (39) adjacent to the stitch forming instruments (7).

10. An automatic sewing device according to claim 9, wherein the retaining device is provided in the form of a suction device (73).

11. An automatic sewing device according to claim 1, having a size measuring device (67) for measuring the size of the workpiece (68).

12. An automatic sewing device according to claims 8, wherein a central control unit (37) is provided to trigger drives (19, 27) for shifting the workpiece holder (12) and the drive (54) for lifting the holding plate (59, 59', 59") off the bearing plate (39) as a function of the size of the workpiece (68) measured by a size measuring device (67).

13. An automatic sewing device according to claim 12, wherein the control unit (37) is formed so as to trigger the retaining device (73).

* * * * *